United States Patent [19]

Brodey et al.

[11] Patent Number: 4,722,111

[45] Date of Patent: Feb. 2, 1988

[54] HAIRBRUSH

[75] Inventors: Hans Brodey; Viktor Frieb, both of Vienna, Austria

[73] Assignee: Eduard Frieb Gesellschaft M.B.H., Vienna, Austria

[21] Appl. No.: 891,326

[22] Filed: Jul. 31, 1986

[51] Int. Cl.[4] ..... A46B 3/16; A46B 9/02

[52] U.S. Cl. ..... 15/159 A; 15/195; 15/DIG. 5; 132/85

[58] Field of Search ..... 15/159 R, 159 A, 186, 15/187, 188, 191 A, 195–205, DIG. 5, DIG. 6; 132/85, 120

[56] References Cited

U.S. PATENT DOCUMENTS

| | | | |
|---|---|---|---|
| 3,727,260 | 4/1973 | Spydevold | 15/195 |
| 3,949,765 | 4/1976 | Vallis | 15/159 A |
| 4,475,261 | 10/1984 | Okumura et al. . | |

FOREIGN PATENT DOCUMENTS

| | | | |
|---|---|---|---|
| 0080121 | 6/1983 | European Pat. Off. . | |
| 0103205 | 3/1984 | European Pat. Off. . | |
| 2020976 | 11/1970 | Fed. Rep. of Germany . | |
| 1938937 | 2/1971 | Fed. Rep. of Germany | 15/159 A |
| 2041032 | 2/1972 | Fed. Rep. of Germany . | |
| 2828289 | 1/1979 | Fed. Rep. of Germany . | |
| 1469552 | 4/1977 | United Kingdom . | |

*Primary Examiner*—Peter Feldman

*Attorney, Agent, or Firm*—Young & Thompson

[57] ABSTRACT

A hairbrush has an assembly of bristle tufts (2), each of which consists of a plurality of natural bristles (6) bent into a U-shape and respectively one synthetic bristle (3) bent into a U-shape, wherein the synthetic bristle (3) has legs (4 and 5) of equal length, these legs being longer than the unequally long legs (7 and 8) of the natural bristles (6).

3 Claims, 5 Drawing Figures

HAIRBRUSH

The invention relates to a hairbrush with an assembly consisting of bristle tufts inserted in mounting holes in a brush body, wherein each bristle tuft comprises natural bristles bent into a U-shape and at least one synthetic bristle likewise bent into a U-shape, the natural bristles and the synthetic bristle being held together in their bending zone accommodated within the mounting hole and being fixed in the mounting hole, and the free length of the natural bristles being smaller than the length of the synthetic bristle which latter has a greater stiffness than the natural bristles and is preferably a monofil, especially of nylon.

Besides hairbrushes having bristle tufts of natural bristles, there are also hairbrushes exhibiting bristle tufts of a mixture of natural and synthetic bristles. Furthermore, hairbrushes have become known studded exclusively with comparatively stiff synthetic resin bristles (cf. DOS No. 2,828,289; British Patent No. 1,469,552; U.S. Pat. No. 4,475,261; and EP-A1-0 103 205). Such hairbrushes display an essentially combing effect without the brushing action beneficial to hair. In the hairbrushes with bristle tufts containing, besides natural bristles, also synthetic bristles, the synthetic bristles have the same length as the natural bristles so that essentially the same, brushing effect results as in hairbrushes solely carrying natural bristles.

A hairbrush is known from DOS No. 2,041,032 having bristle tufts of natural bristles and of synthetic bristles longer than the former bristles.

A hairbrush of the type discussed in the foregoing is known from DOS No. 2,020,976.

EP-B1-0 080 121 and EP-A1-0 103 205 disclose synthetic bristles, the ends of which are shaped into spherical bulges, in connection with hairbrushes solely studded with synthetic bristles.

Hairbrushes exhibiting an assembly of artificial bristles wherein the synthetic bristles, bent into a U-shape, exhibit equal-length legs have been known from DOS No. 2,828,289.

It is an object of the invention to provide a hairbrush of the type discussed hereinabove, exhibiting besides the effect of a conventional brush simultaneously the effect of a comb and, respectively, of a hairbrush studded exclusively with comparatively strong synthetic bristles, wherein the synthetic bristles are not combined into bristle tufts.

This object has been attained according to the invention in that the legs of the natural bristles exhibit differing lengths; that the legs of the synthetic bristle are of equal length; and that the free ends of the synthetic bristle of each bristle tuft are shaped into a substantially spherical bulge.

On account of the structure of the hairbrush in accordance with this invention, there results, besides the brushing effect supplied by the natural bristles, a combing effect by the synthetic bristles projecting beyond the natural bristles. Since the synthetic bristles are encompassed by a clip together with the natural bristles, the synthetic bristles of each bristle tuft, differently from synthetic bristles merely inserted in bristle tufts of natural bristles, are securely retained. It is possible by means of a hairbrush designed according to this invention to seize hair in a parting fashion and grasp it, for example, for curling without any problems.

On account of the fact that, in the invention, the legs of the natural bristles have differing lengths, the brushing effect of the hairbrush of the invention is further enhanced. The thorough combing action is achieved in the invention by the fact that the legs of the synthetic bristle are of equal length.

The brushing and simultaneously combing effect intended by this invention is attained especially advantageously if the length of the legs of the synthetic bristles projecting beyond the brush body has a relationship to the length of the longer leg of the natural bristles of 15:10 to 11:10, preferably of 13:10, the provision being usually made that the free length of the longer leg of the natural bristles has a ratio of 19:10 to 13:10, preferably 17:10 to 15:10.

Additional details of the invention can be seen from the following description of the preferred embodiments of hairbrushes according to this invention depicted in the drawing wherein.

Before the illustrated embodiments will be described in detail, it is to be noted that the shape of the brush body is of no importance to the invention, and that the illustrated embodiments are not to be considered as limiting.

Figure 2:
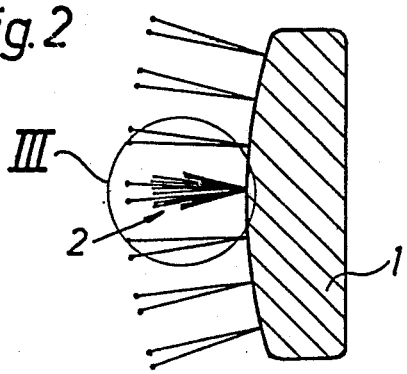
FIG. 2 shows a section along line II—II in FIG. 1.
Figure 1:
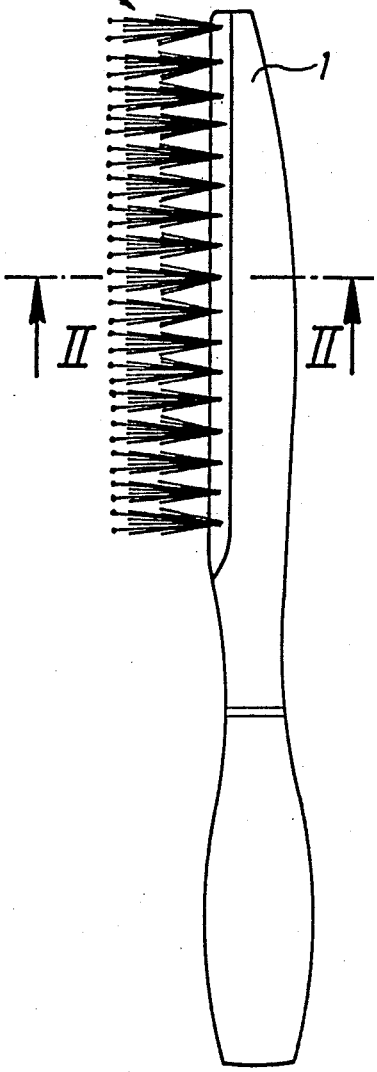
FIG. 1 shows a lateral view of a hairbrush.
Figure 3:
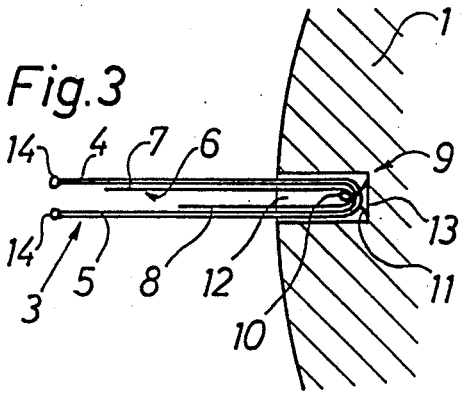
FIG. 3 shows detail III of FIG. 2 on an enlarged scale.

A hairbrush shown in FIG. 1 consists of a brush body 1 studded with several bristle tufts 2. Each bristle tuft 2 is made up of a synthetic bristle 3, which is, for example, a monofil of nylon and is bent into a U-shape, the two legs 4 and 5 of the synthetic bristle 3 being of equal length. The monofil constituting the synthetic bristle 3 can have diameters of between 0.2 and 0.8 mm, the diameter of the monofil being selected in dependence on the desired hardness of the brush.

Each bristle tuft 2 contains, besides the synthetic bristle 3, 30 to 70+10 natural bristles 6 bent into a U-shape. The natural bristles possess diameters of between 0.10 and 0.30 mm. The natural bristles 6 are bent asymmetrically, as contrasted to the synthetic bristle 3, so that there result a longer leg 7 and a shorter leg 8.

Each bristle tuft 2, consisting of one synthetic bristle 3 bent into a U-shape, and several natural bristles 6 bent into a U-shape, is held together in the bending zone 9 by means of a clip 10. The clip 10 consists, for example, of wire coated with copper or tin, bent into a loop (ring) surrounding the bending zone 9, the ends 11 of the wire forming the clip 10 resting on the bottom of the mounting hole 12 in the brush body 1 accommodating the bristle tufts 2. The ring of the clip 10 is in contact with the sidewalls of the mounting hole 12 so that, in combination with the ends 11 resting on the bottom 13 of the hole 12, a secure mounting of the bristle tufts 2 in the brush body 1 is obtained.

The free ends of the synthetic bristles 3 are shaped into an essentially spherical bulge 14.

Figure 5:
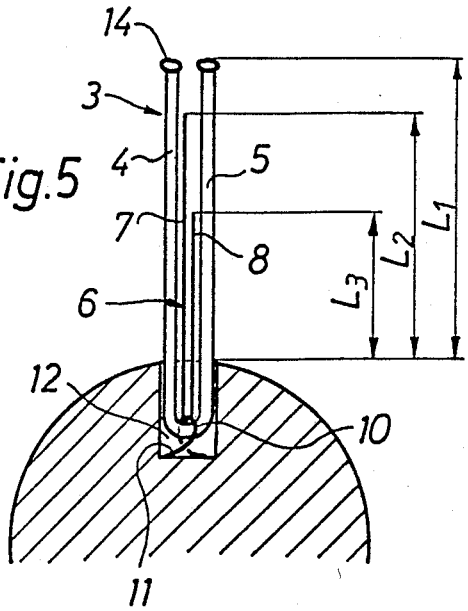
FIG. 5 shows detail V of FIG. 4 on an enlarged scale.
Figure 4:
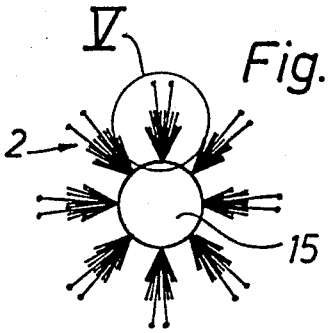
FIG. 4 shows a brush according to this invention, fashioned as a circular brush.

The embodiment of a hairbrush according to this invention illustrated in FIGS. 4 and 5 exhibits a brush body 15 with an essentially circular cross section, the bristle tufts 2 being distributed over the outer surface area thereof. Here again, each bristle tuft 2 consists of a synthetic bristle 3 bent into a U-shape, the ends of which have an enlarged portion 14, and of several natural bristles 6 bent asymmetrically into a U-shape, all of the bristles of a bristle tuft 2 being held together with the aid of a bracket 10.

The length $L_1$ of the legs 4 and 5 of the synthetic bristles 3 projecting past the brush body 1 or 15 has a relationship to the length $L_2$ of the longer leg 7 of the natural bristle 6 like 15 to 11:10, preferably like 13:10.

The free length $L_2$ of the longer leg 7 of the natural bristles 6 has a relationship to the length $L_3$ of the shorter leg 8 of the natural bristles 6 like 19 to 13:10, preferably like 17 to 15:10.

Examples for length combinations are compiled in the table below, the length being indicated respectively in millimeters:

TABLE

| | (Length in mm) | | |
|---|---|---|---|
| | $L_1$ | $L_2$ | $L_3$ |
| Round Brush Ø 14 mm | 13 ± 0.5 | 10 ± 1.0 | 6 ± 1.0 |
| Flat Brush | 18 ± 0.5 | 14 ± 1.5 | 8 ± 1.5 |
| Round Brush Ø 20 mm | 17 ± 0.5 | 13 ± 1.0 | 8 ± 1.0 |
| Flat Brush | 20 ± 0.5 | 15 ± 1.5 | 10 ± 1.5 |

An advantageous, hair-pampering action results with the brush fashioned in accordance with this invention. On account of the natural bristles which are, for example, wild boar bristles, an effect results, because of their irregular surface, which cleanses the hair surface from oils and dirt. In contrast thereto, the longer synthetic bristles separate and pass through the hair, thus making it possible for the natural bristles to deploy their cleansing, smoothing, and luster-imparting action. If the synthetic bristles are equipped with thickenings at their free ends, the scalp is not irritated and, at the same time, penetration of the synthetic bristles into the hair is facilitated.

Accordingly, the brush of this invention achieves not only a smoothing and straightening, but also untangling effect, accompanied by a cleansing and luster-imparting effect.

The natural bristles 6 and the synthetic bristle 3 can be held together, instead of by a clip 10, also by punched anchoring means, mounting by fusion (melting the bristles into a support), vulcanizing, or the like.

What is claimed is:

1. Hairbrush with an assembly consisting of bristle tufts inserted in mounting holes in a brush body, wherein each bristle tuft comprises natural bristles bent into a U-shape and at least one synthetic bristle likewise bent into a U-shape, the natural bristles and the synthetic bristle being held together in their bending zone accommodated within the mounting hole and being fixed in the mounting hole, and the free length of the natural bristles being smaller than the length of the synthetic bristle which latter has a greater stiffness than the natural bristles, characterized in that the legs (7, 8) of the natural bristles (6) exhibit differing lengths ($L_2$, $L_3$); that the legs (4, 5) of the synthetic bristle (3) are of equal length ($L_1$); and that the free ends of the synthetic bristle (3) of each bristle tuft (2) are shaped into an essentially spherical bulge (14).

2. Brush according to claim 1, characterized in that the length ($L_1$) of the legs (4, 5) of the synthetic bristle (3) projecting beyond the brush body (1, 15) has a relationship to the length ($L_2$) of the longer leg (7) of the natural bristles (6) like 15:10 to 11:10.

3. Brush according to claim 1, characterized in that the free length ($L_2$) of the longer leg (7) of the natural bristles (6) has a relationship to the free length ($L_3$) of the shorter leg (8) of the natural bristles (6) like 19:10 to 13:10.

* * * * *